US012303095B2

(12) United States Patent
Ohm et al.

(10) Patent No.: US 12,303,095 B2
(45) Date of Patent: May 20, 2025

(54) MOBILE ROBOT CLEANING HEAD SUSPENSION

(71) Applicant: iRobot Corporation, Bedford, MA (US)

(72) Inventors: Timothy R. Ohm, Grover Beach, CA (US); David O. Swett, Bedford, MA (US); Fangzheng Guo, Arlington, MA (US)

(73) Assignee: iRobot Corporation, Bedford, MA (US)

( * ) Notice: Subject to any disclaimer, the term of this patent is extended or adjusted under 35 U.S.C. 154(b) by 186 days.

(21) Appl. No.: 17/732,735

(22) Filed: Apr. 29, 2022

(65) Prior Publication Data

US 2023/0346181 A1 Nov. 2, 2023

(51) Int. Cl.
*A47L 9/04* (2006.01)

(52) U.S. Cl.
CPC ..... *A47L 9/0494* (2013.01); *A47L 2201/00* (2013.01)

(58) Field of Classification Search
CPC ... A47L 9/0494; A47L 2201/00; A47L 9/0477
See application file for complete search history.

(56) References Cited

U.S. PATENT DOCUMENTS

| | | | | |
|---|---|---|---|---|
| 11,723,503 | B2 * | 8/2023 | Mathieu | A47L 11/282 15/319 |
| 2018/0213987 | A1 | 8/2018 | Hong et al. | |
| 2021/0030227 | A1 * | 2/2021 | Mathieu | A47L 9/0477 |

FOREIGN PATENT DOCUMENTS

| | | |
|---|---|---|
| DE | 102010000577 | 8/2011 |
| KR | 20130107642 | 10/2013 |

OTHER PUBLICATIONS

"International Application Serial No. PCT US2023 017454, International Search Report mailed Jul. 31, 2023", 5 pgs.
"International Application Serial No. PCT US2023 017454, Written Opinion mailed Jul. 31, 2023", 7 pgs.
"International Application Serial No. PCT US2023 017454, International Preliminary Report on Patentability mailed Nov. 7, 2024", 9 pgs.

* cited by examiner

*Primary Examiner* — Bryan R Muller

(74) *Attorney, Agent, or Firm* — Schwegman Lundberg & Woessner, P.A.

(57) ABSTRACT

A mobile cleaning robot can be movable within an environment. The mobile cleaning robot can include a body, a cleaning head, a biasing element, and a linkage. The cleaning head can be operable to extract debris from a floor surface and can be configured to move vertically relative to the body between an extended position and a retracted position. The biasing element can be connected to the body and can be movable with the cleaning head. The linkage can be connected to the cleaning head and the biasing element. The linkage can be rotatably connected to the body to, together with the biasing element, bias the cleaning head toward the retracted position.

16 Claims, 11 Drawing Sheets

MOBILE ROBOT CLEANING HEAD SUSPENSION

BACKGROUND

Mobile robots include mobile cleaning robots that can perform cleaning tasks within an environment, such as a home. A mobile cleaning robot can navigate across a floor surface and avoid obstacles while vacuuming the floor surface and operating rotatable members carried by the robot to ingest debris from the floor surface. As the robot moves across the floor surface, the robot can rotate the rotatable members, which can engage the debris and guide the debris toward a vacuum airflow generated by the robot. The rotatable members and the vacuum airflow can thereby cooperate to allow the robot to ingest debris.

SUMMARY

Mobile cleaning robots can autonomously navigate through environments to perform cleaning operations, often traversing over, and navigating around, obstacles. Mobile cleaning robots can include cleaning heads having suspension systems to provide sufficient cleaning head downforce to provide effective cleaning on various surfaces. Because floor types can vary in type and height, a desirable cleaning head position relative to the robot body can vary to maintain good cleaning efficiency. It can also desirable to also maintain a relatively constant downforce on the cleaning head as the head moves relative to the body of the robot to achieve good cleaning efficiency and effectiveness.

Some components of the cleaning head (or connected thereto) must be configured to allow movement of the cleaning head, such as the plenum. For example, the plenum must be configured to stretch or flex to remain connected to the cleaning head and a vacuum pathway to ensure that debris can be directed from the cleaning head to a debris bin. However, in using such a plenum, forces can be applied to the cleaning head by the plenum based on movement of the plenum. For example, as the cleaning head translates down, the plenum can move from a neutral position and apply an upward force on the cleaning head. The inverse can occur when the cleaning head moves up to pull the plenum above its neutral position. The resulting varying forces from the plenum can create an undesirable force profile on the cleaning head which can result in undesirable cleaning performance.

This disclosure describes devices and methods that can help to address this problem such as by including a passive cleaning head suspension system to compensate for the forces of the plenum and to achieve a desirable downforce profile over an entirety (or nearly) of a range of motion of the cleaning head assembly. That is, such a suspension system can include a biasing system or assembly that can be configured to deliver force to the cleaning head assembly over a desired force profile to cancel out the effects of the plenum and to help position the cleaning head assembly for optimal or efficient extraction and cleaning performance. This can be achieved by including a linkage connected to a biasing element where the linkage offsets or alters a natural force profile of the biasing elements as it stretches or changes over a range of travel of the cleaning head and the suspension.

For example, a mobile cleaning robot can be movable within an environment. The mobile cleaning robot can include a body, a cleaning head, a biasing element, and a linkage. The cleaning head can be operable to extract debris from a floor surface and can be configured to move vertically relative to the body between an extended position and a retracted position. The biasing element can be connected to the body and can be movable with the cleaning head. The linkage can be connected to the cleaning head and the biasing element. The linkage can be rotatably connected to the body to, together with the biasing element, bias the cleaning head toward the retracted position.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Robot Overview

Figure 1:
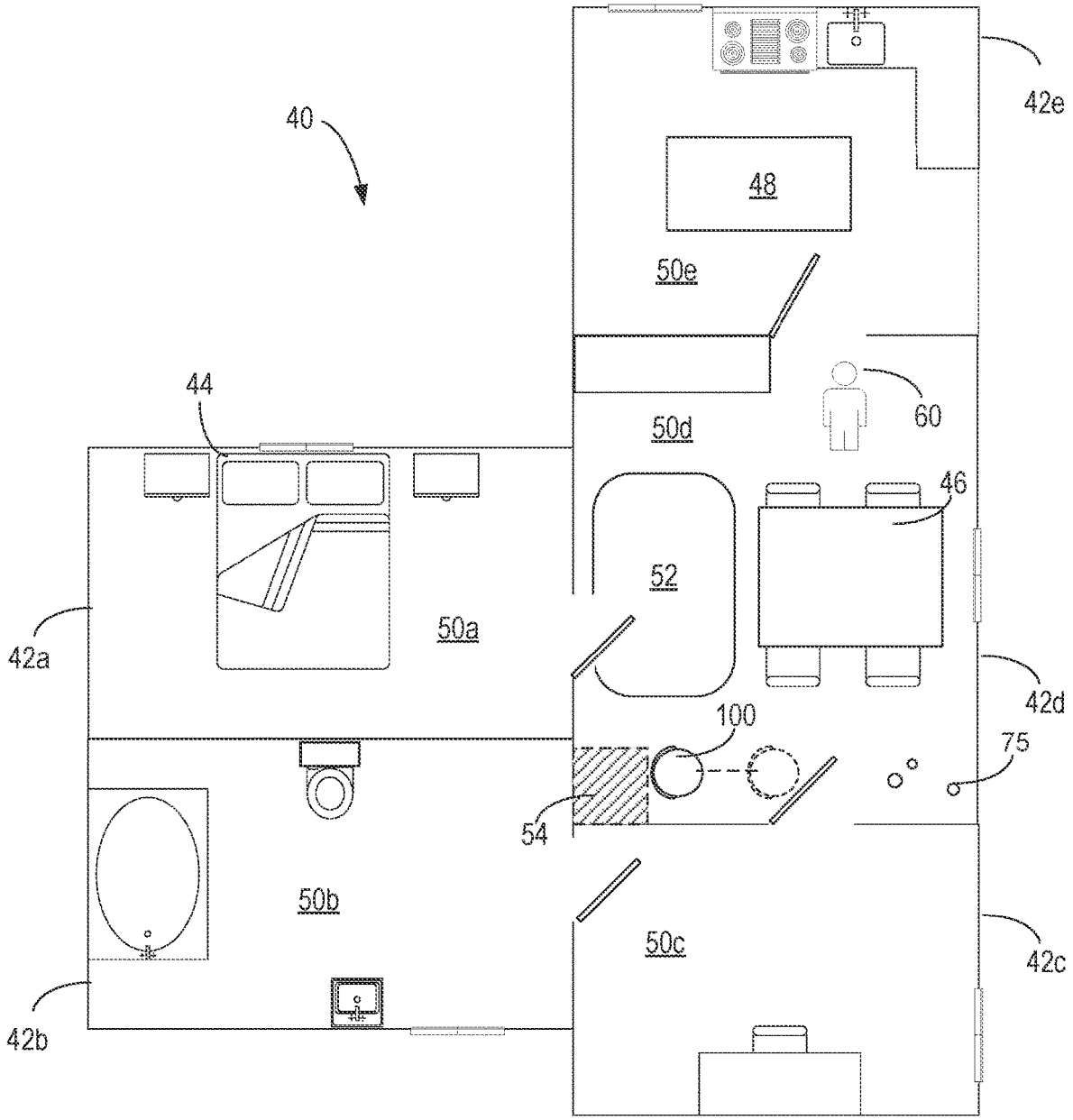
FIG. 1 illustrates a plan view of a mobile cleaning robot in an environment.

FIG. 1 illustrates a plan view of a mobile cleaning robot 100 in an environment 40. The environment 40 can be a dwelling, such as a home or an apartment, and can include rooms 42*a*-42*e*. Obstacles, such as a bed 44, a table 46, and an island 48 can be located in the rooms 42 of the environment. Each of the rooms 42*a*-42*e* can have a floor surface 50*a*-50*e*, respectively. Some rooms, such as the room 42*d*, can include a rug, such as a rug 52. The floor surfaces 50 can be of one or more types such as hardwood, ceramic, low-pile carpet, medium-pile carpet, long (or high)-pile carpet, stone, or the like.

The mobile cleaning robot 100 can be operated, such as by a user 60, to autonomously clean the environment 40 in a room-by-room fashion. In some examples, the robot 100 can clean the floor surface 50*a* of one room, such as the room 42*a*, before moving to the next room, such as the room 42*d*, to clean the surface of the room 42*d*. Different rooms can have different types of floor surfaces. For example, the room 42*e* (which can be a kitchen) can have a hard floor surface, such as wood or ceramic tile, and the room 42*a* (which can be a bedroom) can have a carpet surface, such as a medium pile carpet. Other rooms, such as the room 42*d* (which can be a dining room) can include multiple surfaces where the rug 52 is located within the room 42*d*. The robot 100 can be configured to navigate over various floor types through one or more components such as a suspension. The suspension of the robot can also allow the robot 100 to navigate over obstacles, such as thresholds between rooms or over rugs, such as the rug 52.

Also, during cleaning or traveling operations, the robot 100 can use data collected from various sensors (such as optical sensors) and calculations (such as odometry and obstacle detection) to develop a map of the environment 40. Once the map is created, the user 60 can define rooms or zones (such as the rooms 42) within the map. The map can be presentable to the user 60 on a user interface, such as a mobile device, where the user 60 can direct or change cleaning preferences, for example.

During operation, the robot 100 can detect surface types within each of the rooms 42, which can be stored in the robot or another device. The robot 100 can update the map (or data related thereto) such as to include or account for surface types of the floor surfaces 50*a*-50*e* of each of the respective rooms 42 of the environment. In some examples, the map can be updated to show the different surface types such as within each of the rooms 42.

Components of the Robot

Figure 2A:
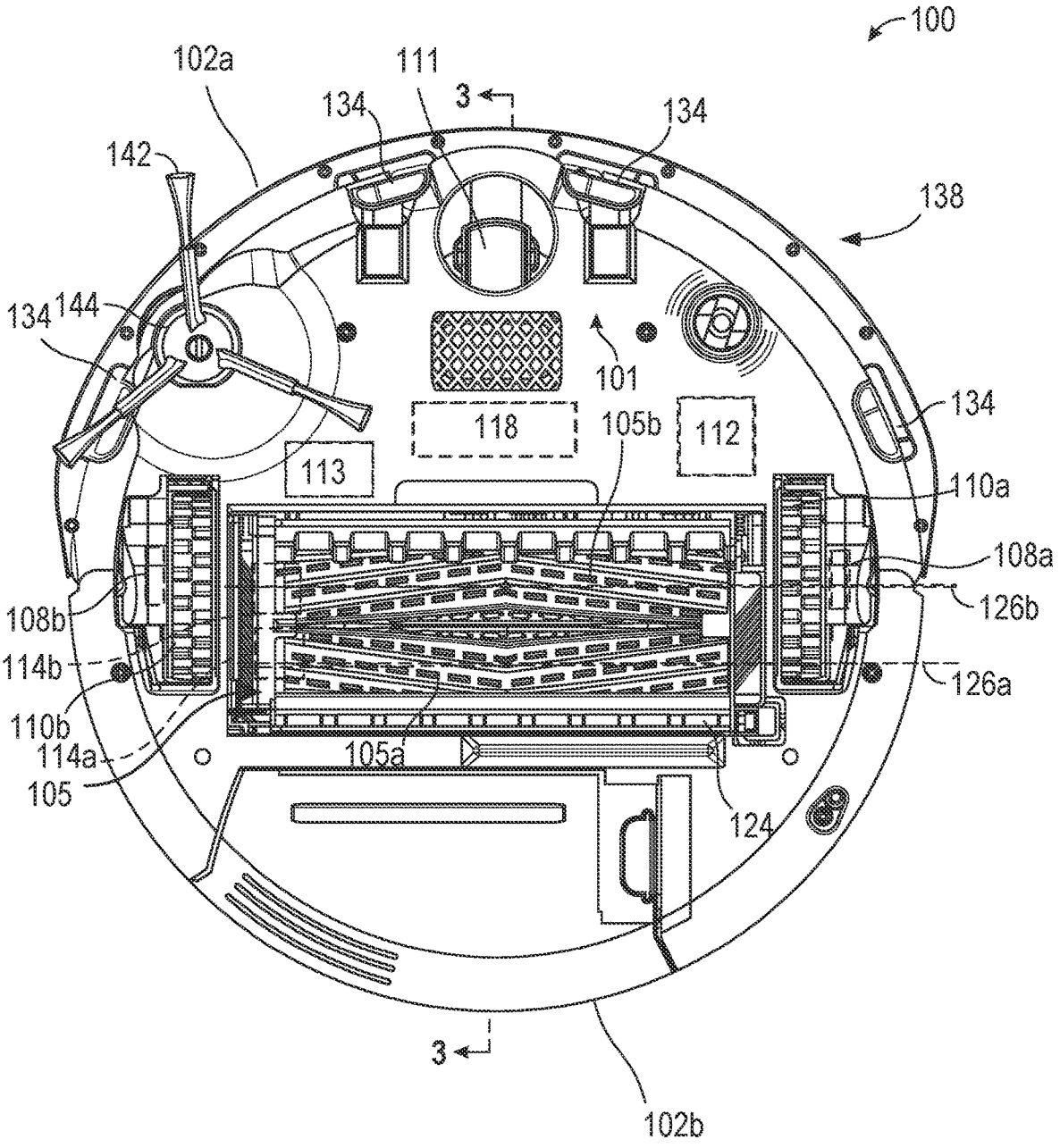
FIG. 2A illustrates a bottom view of a mobile cleaning robot.
Figure 2B:
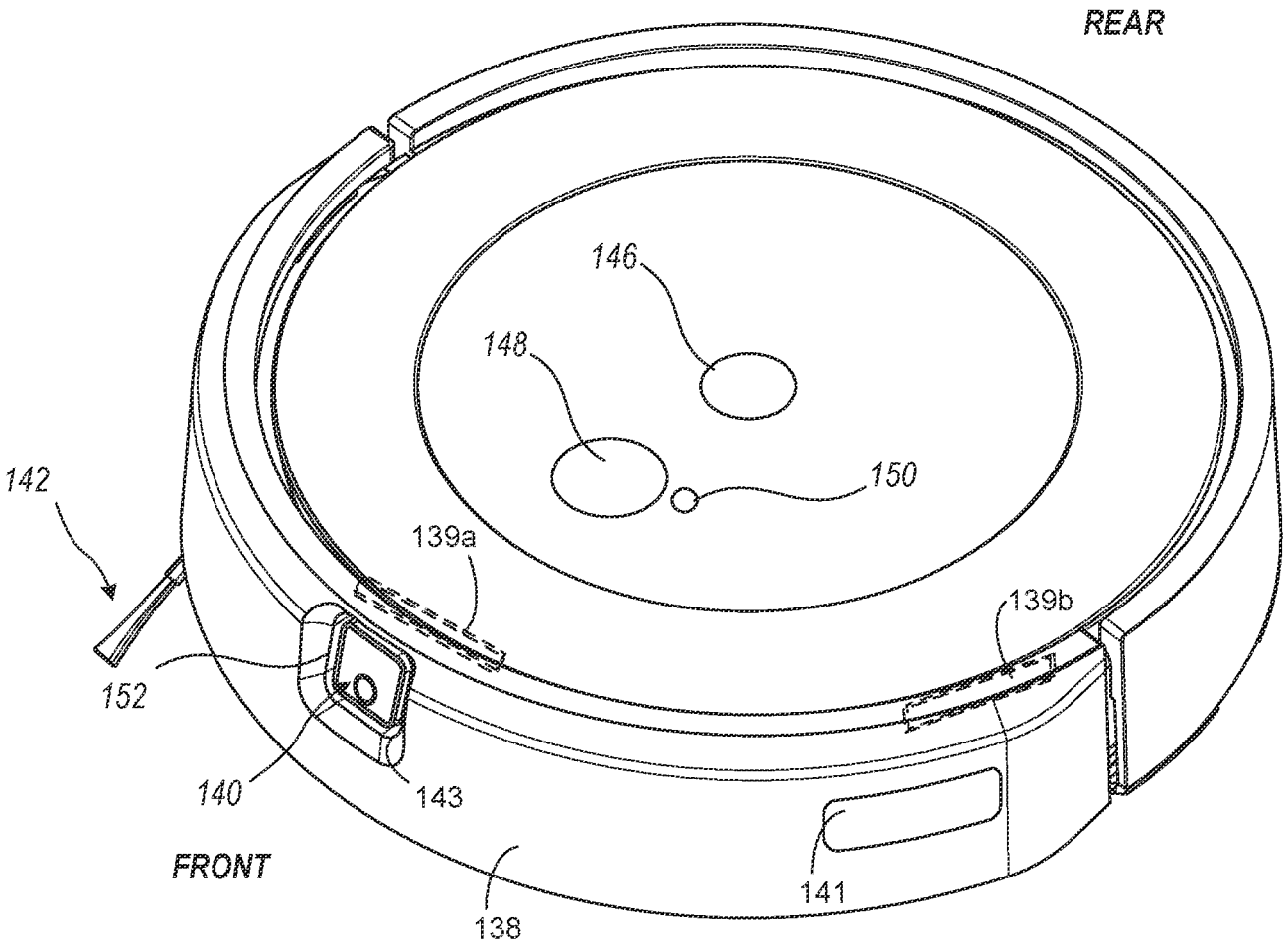
FIG. 2B illustrates an isometric view of a mobile cleaning robot.
Figure 3:
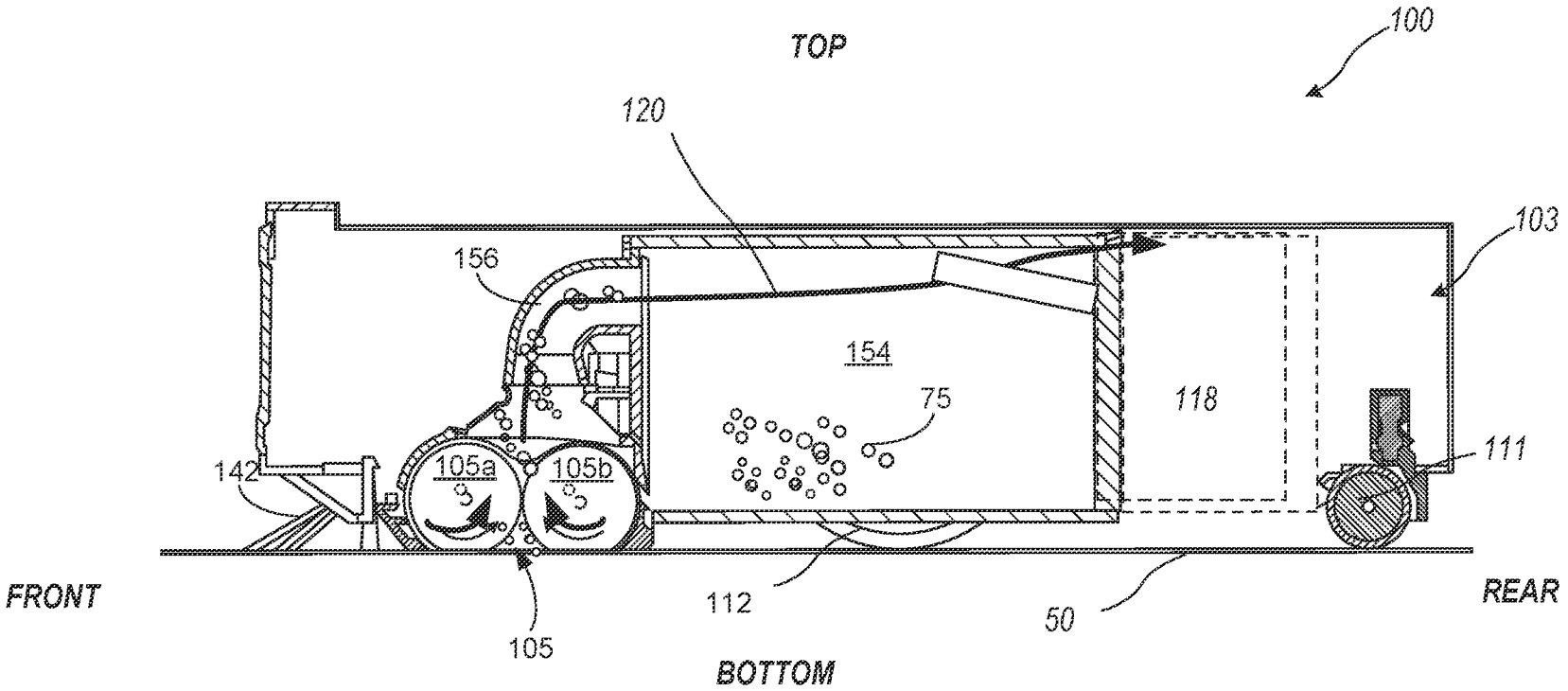
FIG. 3 illustrates a cross-sectional view across indicators 3-3 of FIG. 2A of a mobile cleaning robot.

FIG. 2A illustrates a bottom view of the mobile cleaning robot 100. FIG. 2B illustrates a bottom view of the mobile cleaning robot 100. FIG. 3 illustrates a cross-section view across indicators 3-3 of FIG. 2A of the mobile cleaning robot 100. FIG. 3 also shows orientation indicators Bottom, Top, Front, and Rear. FIGS. 2A-3 are discussed together below.

The cleaning robot 100 can be a mobile cleaning robot that can autonomously traverse the floor surface 50 while ingesting the debris 75 from different parts of the floor surface 50. As depicted in FIGS. 2A and 3, the robot 100 can include a body 101 movable across the floor surface 50. The body 101 can include multiple connected structures to which movable components of the cleaning robot 100 can be mounted. The connected structures can include an outer housing to cover internal components of the cleaning robot 100, a chassis to which drive wheels 110*a* and 110*b* and the cleaning rollers 105*a* and 105*b* (of a cleaning assembly 105) are mounted, and a bumper 138 mounted to the outer housing.

As shown in FIG. 2A, the body 101 can include a front portion 102*a* that has a substantially semicircular shape and a rear portion 102*b* that has a substantially semicircular shape. As shown in FIG. 2A, the robot 100 can include a drive system including actuators 108*a* and 108*b*, e.g., motors, operable with drive wheels 110*a* and 110*b*. The actuators 108*a* and 108*b* can be mounted in the body 101 and can be operably connected to the drive wheels 110*a* and 110*b*, which are rotatably mounted to the body 101. The drive wheels 110*a* and 110*b* can support the body 101 above the floor surface 50. The actuators 108*a* and 108*b*, when driven, can rotate the drive wheels 110*a* and 110*b* to enable the robot 100 to move across the floor surface 50.

The controller (or processor) 212 can be located within the housing 103 and can be a programmable controller, such as a single or multi-board computer, a direct digital controller (DDC), a programmable logic controller (PLC), or the like. In other examples the controller 112 can be any computing device, such as a handheld computer, for example, a smart phone, a tablet, a laptop, a desktop computer, or any other computing device including a processor and communication capabilities. The memory 113 can be one or more types of memory, such as volatile or non-volatile memory, read-only memory (ROM), random-access memory (RAM), magnetic disk storage media, optical storage media, flash-memory devices, and other storage devices and media. The memory 113 can be located within the housing 103 and can be connected to the controller 112 and accessible by the controller 112.

The controller 112 can operate the actuators 108*a* and 108*b* to autonomously navigate the robot 100 about the floor surface 50 during a cleaning operation. The actuators 108*a* and 108*b* are operable to drive the robot 100 in a forward drive direction, in a backwards direction, and to turn the robot 100. The robot 100 can include a caster wheel 111 (or alternatively skids) that supports the body 101 above the floor surface 50. The caster 111 can support the front portion 102*a* of the body 101 above the floor surface 50, and the drive wheels 110*a* and 110*b* support a middle and rear portion 102*b* of the body 101 above the floor surface 50.

As shown in FIG. 3, a vacuum assembly 118 can be located within the body 101 of the robot 100, e.g., in the middle of the body 101. The controller 112 can operate the vacuum assembly 118 to generate an airflow that flows through the air gap near the cleaning rollers 105*a* and 105*b*, through the body 101, and out of the body 101. The vacuum assembly 118 can include, for example, an impeller that generates the airflow when rotated. The airflow and the cleaning rollers 105*a* and 105*b*, when rotated, cooperate to ingest debris 75 into the robot 100. A cleaning bin 154 can be mounted in the body 101 to contain the debris 75 ingested by the robot 100 through a suction duct or plenum 156. A filter in the body 101 can separate the debris 75 from the airflow before the airflow 120 enters the vacuum assembly 118 and is exhausted out of the body 101. In this regard, the debris 75 is captured in both the cleaning bin 154 and the filter before the airflow 120 is exhausted from the body 101.

The cleaning rollers 105*a* and 105*b* can operably connected to actuators 114*a* and 114*b*, e.g., motors, respectively. The cleaning head 105 and the cleaning rollers 105*a* and 105*b* can positioned forward of the cleaning bin 154. The cleaning rollers 105*a* and 105*b* can be mounted to a housing 124 of the cleaning head 105 and mounted, e.g., indirectly or directly, to the body 101 of the robot 100. For example, the cleaning rollers 105*a* and 105*b* can be mounted to an underside of the body 101 so that the cleaning rollers 105*a* and 105*b* engage debris 75 on the floor surface 50 during the cleaning operation when the underside faces the floor surface 50.

The housing 124 of the cleaning head 105 can be mounted to the body 101 of the robot 100. In this way, the cleaning rollers 105*a* and 105*b* can also mounted to the body 101 of the robot 100, e.g., indirectly mounted to the body 101 through the housing 124. The cleaning head 105 can also be a removable assembly of the robot 100 where the housing 124 with the cleaning rollers 105*a* and 105*b* mounted therein is removably mounted to the body 101 of the robot 100. The housing 124 and the cleaning rollers 105*a* and 105*b* can be removable from the body 101 as a unit so that the cleaning head 105 is easily interchangeable with a replacement cleaning head 105.

The control system can further include a sensor system with one or more electrical sensors. The sensor system, as described herein, can generate a signal indicative of a current location of the robot 100, and can generate signals indicative of locations of the robot 100 as the robot 100 travels along the floor surface 50.

Cliff sensors 134 (shown in FIG. 2A) can be located along a bottom portion of the housing 103. Each of the cliff sensors 134 can be an optical sensor that can be configured to detect a presence or absence of an object below the optical sensor, such as the floor surface 50. The cliff sensors 134 can be connected to the controller 112. A bumper 138 can be removably secured to the body 101 and can be movable relative to body 101 while mounted thereto. In some examples, the bumper 138 form part of the body 101. The bump sensors 139*a* and 139*b* (the bump sensors 139) can be connected to the body 101 and engageable or configured to interact with the bumper 138. The bump sensors 139 can include break beam sensors, capacitive sensors, switches, or other sensors that can detect contact between the robot 100, i.e., the bumper 138, and objects in the environment 40. The bump sensors 139 can be in communication with the controller 112.

An image capture device 140 can be a camera connected to the body 101 and can extend through the bumper 138 of the robot 100, such as through an opening 143 of the bumper 138. The image capture device 140 can be a camera, such as a front-facing camera, configured to generate a signal based on imagery of the environment 40 of the robot 100 as the robot 100 moves about the floor surface 50. The image capture device 140 can transmit the signal to the controller 112 for use for navigation and cleaning routines.

Obstacle following sensors 141 (shown in FIG. 2B) can include an optical sensor facing outward from the bumper 138 and that can be configured to detect the presence or the absence of an object adjacent to a side of the body 101. The obstacle following sensor 141 can emit an optical beam horizontally in a direction perpendicular (or nearly perpendicular) to the forward drive direction of the robot 100. The optical emitter can emit an optical beam outward from the robot 100, e.g., outward in a horizontal direction, and the optical detector detects a reflection of the optical beam that reflects off an object near the robot 100. The robot 100, e.g., using the controller 112, can determine a time of flight of the optical beam and thereby determine a distance between the optical detector and the object, and hence a distance between the robot 100 and the object.

A side brush 142 can be connected to an underside of the robot 100 and can be connected to a motor 144 operable to rotate the side brush 142 with respect to the body 101 of the robot 100. The side brush 142 can be configured to engage debris to move the debris toward the cleaning assembly 105 or away from edges of the environment 40. The motor 144 configured to drive the side brush 142 can be in communication with the controller 112. The brush 142 can rotate about a non-horizontal axis, e.g., an axis forming an angle between 75 degrees and 90 degrees with the floor surface 50. The brush 142 can be a side brush laterally offset from a center of the robot 100 such that the brush 142 can extend beyond an outer perimeter of the body 101 of the robot 100. Similarly, the brush 142 can also be forwardly offset of a center of the robot 100 such that the brush 142 also extends beyond the bumper 138. Optionally, the robot 100 can include multiple side brushes, such as one located on each side of the body 101, such as in line with drive wheels 110*a* and 110*b*, respectively. The robot 100 can also include a button 146 (or interface) that can be a user-operable interface configured to provide commands to the robot, such as to pause a mission, power on, power off, or return to a docking station. Operation of the Robot In operation of some examples, the robot 100 can be propelled in a forward drive direction or a rearward drive direction. The robot 100 can also be propelled such that the robot 100 turns in place or turns while moving in the forward drive direction or the rearward drive direction.

When the controller 112 causes the robot 100 to perform a mission, the controller 112 can operate the motors 108 to drive the drive wheels 110 and propel the robot 100 along the floor surface 50. In addition, the controller 112 can operate the motors 114 to cause the rollers 105*a* and 105*b* to rotate, can operate the motor 144 to cause the brush 142 to rotate, and can operate the motor of the vacuum system 118 to generate airflow. The controller 112 can execute software stored on the memory 113 to cause the robot 100 to perform various navigational and cleaning behaviors by operating the various motors of the robot 100.

The various sensors of the robot 100 can be used to help the robot navigate and clean within the environment 40. For example, the cliff sensors 134 can detect obstacles such as drop-offs and cliffs below portions of the robot 100 where the cliff sensors 134 are disposed. The cliff sensors 134 can transmit signals to the controller 112 so that the controller 112 can redirect the robot 100 based on signals from the cliff sensors 134.

In some examples, a bump sensor 139*a* can be used to detect movement of the bumper 138 along a fore-aft axis of the robot 100. A bump sensor 139*b* can also be used to detect movement of the bumper 138 along one or more sides of the robot 100. The bump sensors 139 can transmit signals to the controller 112 so that the controller 112 can redirect the robot 100 based on signals from the bump sensors 139.

The image capture device 140 can be configured to generate a signal based on imagery of the environment 40 of the robot 100 as the robot 100 moves about the floor surface 50. The image capture device 140 can transmit such a signal to the controller 112. The image capture device 140 can be angled in an upward direction, e.g., angled between 5 degrees and 45 degrees from the floor surface 50 about which the robot 100 navigates. The image capture device 140, when angled upward, can capture images of wall surfaces of the environment so that features corresponding to objects on the wall surfaces can be used for localization.

In some examples, the obstacle following sensors 141 can detect detectable objects, including obstacles such as furniture, walls, persons, and other objects in the environment of the robot 100. In some implementations, the sensor system can include an obstacle following sensor along a side surface, and the obstacle following sensor can detect the presence or the absence an object adjacent to the side surface. The one or more obstacle following sensors 141 can also serve as obstacle detection sensors, similar to the proximity sensors described herein.

The robot 100 can also include sensors for tracking a distance travelled by the robot 100. For example, the sensor system can include encoders associated with the motors 108 for the drive wheels 110, and the encoders can track a distance that the robot 100 has travelled. In some implementations, the sensor can include an optical sensor facing downward toward a floor surface. The optical sensor can be positioned to direct light through a bottom surface of the robot 100 toward the floor surface 50. The optical sensor can detect reflections of the light and can detect a distance travelled by the robot 100 based on changes in floor features as the robot 100 travels along the floor surface 50.

The controller 112 can use data collected by the sensors of the sensor system to control navigational behaviors of the robot 100 during the mission. For example, the controller 112 can use the sensor data collected by obstacle detection sensors of the robot 100, (the cliff sensors 134, the bump sensors 139, and the image capture device 140) to enable the robot 100 to avoid obstacles within the environment of the robot 100 during the mission.

The sensor data can also be used by the controller 112 for simultaneous localization and mapping (SLAM) techniques in which the controller 112 extracts features of the environment represented by the sensor data and constructs a map of the floor surface 50 of the environment. The sensor data collected by the image capture device 140 can be used for techniques such as vision-based SLAM (VSLAM) in which the controller 112 extracts visual features corresponding to objects in the environment 40 and constructs the map using these visual features. As the controller 112 directs the robot 100 about the floor surface 50 during the mission, the controller 112 can use SLAM techniques to determine a location of the robot 100 within the map by detecting features represented in collected sensor data and comparing the features to previously stored features. The map formed from the sensor data can indicate locations of traversable and non-traversable space within the environment. For example, locations of obstacles can be indicated on the map as non-traversable space, and locations of open floor space can be indicated on the map as traversable space.

The sensor data collected by any of the sensors can be stored in the memory 113. In addition, other data generated for the SLAM techniques, including mapping data forming the map, can be stored in the memory 113. These data produced during the mission can include persistent data that are produced during the mission and that are usable during further missions. In addition to storing the software for causing the robot 100 to perform its behaviors, the memory 113 can store data resulting from processing of the sensor data for access by the controller 112. For example, the map can be a map that is usable and updateable by the controller 112 of the robot 100 from one mission to another mission to navigate the robot 100 about the floor surface 50.

The persistent data, including the persistent map, helps to enable the robot 100 to efficiently clean the floor surface 50. For example, the map enables the controller 112 to direct the robot 100 toward open floor space and to avoid non-traversable space. In addition, for subsequent missions, the controller 112 can use the map to optimize paths taken during the missions to help plan navigation of the robot 100 through the environment 40.

Suspension Examples

Figure 4:
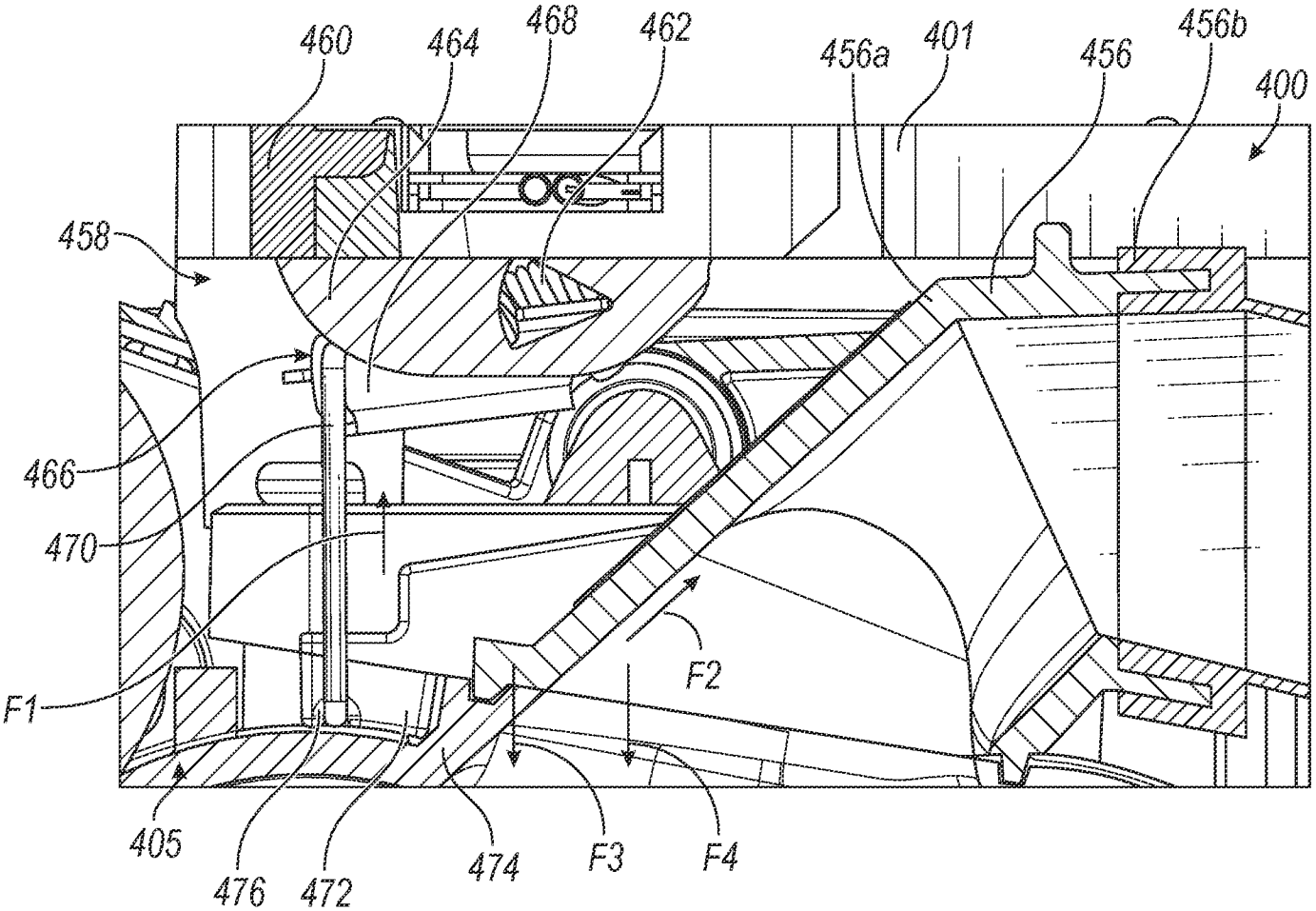
FIG. 4 illustrates a cross-section view of a portion of a cleaning head and cleaning head suspension of a mobile cleaning robot.

FIG. 4 illustrates a cross-section view of a portion of a cleaning head and cleaning head suspension of a mobile cleaning robot 400. The mobile cleaning robot 400 can be similar to the robot 100 discussed above such that like numerals can represent like components (e.g., cleaning head assembly 105 and 405). FIG. 4 discusses details of a passive cleaning head suspension system 458 that can help to compensate for the forces of the plenum and deliver a force to bias the cleaning head to a retracted position, as desired.

The mobile cleaning robot 400 can include a body or housing 401 and can include a plenum 456 can be connected to the housing 401. The plenum 456 can include a rigid portion 456*a* and a flexible portion 456*b*. Optionally, both portions of the plenum 456 can be flexible. The plenum 456 can also be connected to a cleaning head assembly 405. The cleaning head assembly 405 can also be connected to the housing 401, such as through the cleaning head suspension system 458. The cleaning head assembly 405 can be configured to move vertically with respect to the housing 401, for example as the housing 401 traverses over floor surfaces of different types. For example, a high-pile carpet may cause the cleaning head assembly 405 to retract vertically (e.g., upward) and a hard floor surface may allow the cleaning head assembly 405 to extend vertically (e.g., downward). As discussed above, the cleaning head assembly 405 can be operable to extract debris from the environment 40 and the debris can be delivered to a debris bin (e.g., cleaning bin 154) through the plenum 456. The flexible portion 456*b* of the plenum allows the cleaning head assembly 405 to move vertically during cleaning operations while maintaining a seal of the plenum 456.

The mobile cleaning robot 400 can also include an upper support 460 that can be connected to or part of the housing 401. Optionally, the upper support 460 can be part of or can be connected to a wire raceway, as discussed in further detail below. The passive cleaning head suspension system 458 can be connected to the upper support 460 to connect the cleaning head suspension system 458 to the housing, or the cleaning head suspension system 458 can be connected to the housing 401 directly. Alternatively, the passive cleaning head suspension system 458 could be inverted. In other words, the support 464 can be connected to the cleaning head 405 with the connector 470 then connecting to the housing 401.

The cleaning head suspension system 458 can include a biasing element 462 connected to the body 401 and movable with the cleaning head assembly 405. The passive cleaning head suspension system 458 can also include a support 464 (or saddle) connected to the body and connected to a linkage 466. A first end of the biasing element 462 can be connected to the support 464 to connect the biasing element 462 to the upper support 460.

The linkage 466 can include an armature 468 and a connector 470 (or connector member). The connector 470 can be connected to the cleaning head 405 and can be connected to the biasing element 462. The armature 468 and the connector 470 of the linkage 466 can be rotatably connected to the body (such as via the support 464), to, together with the biasing element 462, bias the cleaning head 405 toward the retracted position. Because the flexible portion 456*b* of the plenum 456 can be made of a flexible material, the plenum 456 can allow the cleaning head assembly 405 to move without the plenum 456 becoming disconnected or breaking during such movement. Because of this flexibility of the flexible portion 456*b*, the stretched flexible portion 456*b* can apply a Force F2 as the cleaning head assembly 405 extends from the housing 401 toward an extended position. In other examples, the force F2 can change directions depending on a position of the cleaning head 405 with respect to the housing 401. The force F2 can be limited to a vertical component by a linkage (480 noted below) of the cleaning head 405.

The connector 470 can be connected to a connection portion 472 of the cleaning head 405, which can be connected to a housing 474 of the cleaning head assembly 405. In some examples, the connection portion 472 can include a notch or recess 476 to receive and retain the connector 470 such as to connect the connector 470 and therefore the linkage 466 to the connection portion 472 (and therefore the plenum 456 and the housing 474 of the cleaning head assembly 405). Through this connection, the linkage 466 of the cleaning head suspension system 458 can apply a force F1 across the plenum 456 (such as in parallel with the flexible portion 456*b* or in parallel to the vertical forces applied thereby) to bias the plenum 456 and the cleaning head assembly 405 upward towards a retracted position.

This force F1 can help to balance out the force F2 applied by the plenum 456 to the cleaning head assembly 405 when the plenum 456 is stretched or compressed. The force F3 can be a weight or caused by a mass of the mobile cleaning robot 400. A delivered downforce F4 can be a resultant force delivered to the cleaning head or cleaning head 405. The delivered downforce F4 can be equal to the weight F3 minus the biasing force F1 and the vertical component of the plenum force F2. The passive cleaning head suspension system 458 can be designed such that a desired downforce profile is delivered by the cleaning head assembly 405 over a range of movement of the cleaning head assembly 405 between a retracted position and an extended position, as discussed in further detail below. (Frictional or hysteresis forces can also affect the delivered downforce, but such forces can also be compensated for by the biasing force F1 to a delivered a desired downforce profile.)

Figure 5A:
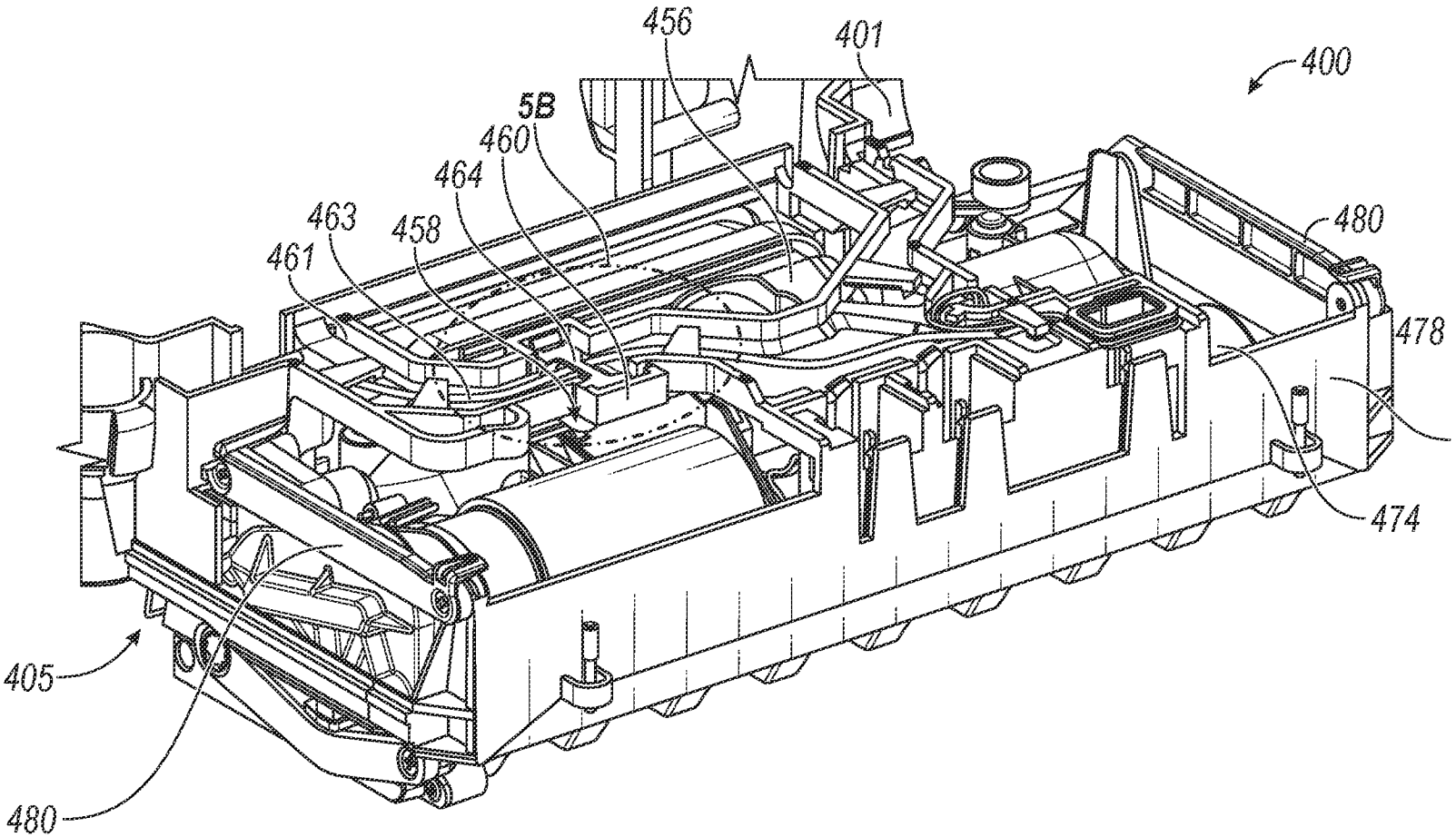
FIG. 5A illustrates an isometric top view of a cleaning head of a mobile cleaning robot
Figure 5B:
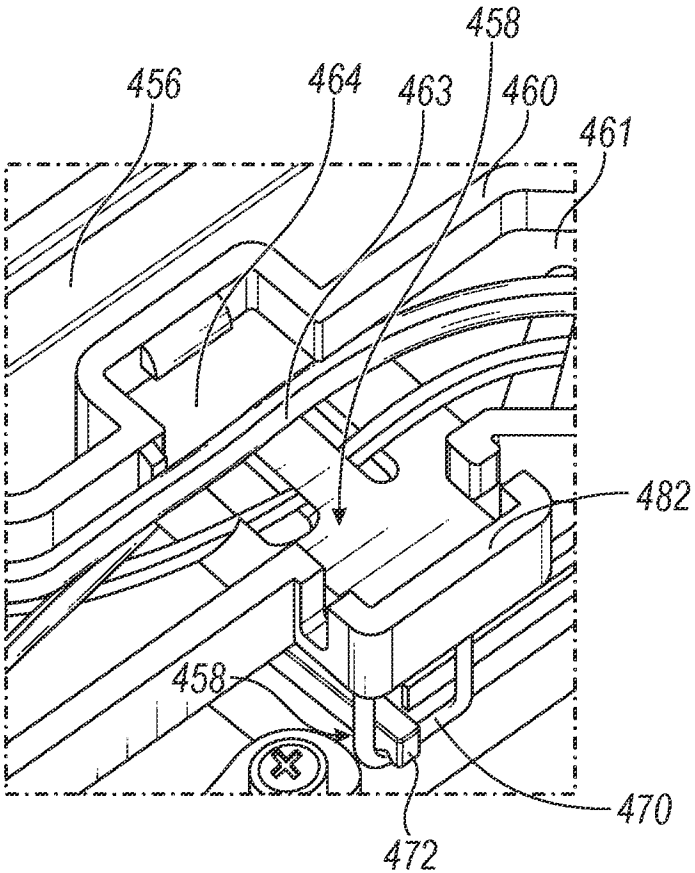
FIG. 5B illustrates an enlarged isometric top view of a portion of the mobile cleaning robot of FIG. 5A

FIG. 5A illustrates an isometric top view of a cleaning head of the mobile cleaning robot 400. FIG. 5B illustrates an enlarged isometric top view of a portion of the mobile cleaning robot 400 of FIG. 5A. FIGS. 5A and 5B are discussed together below. The mobile cleaning robot 400 of FIGS. 5A and 5B can be consistent with the mobile cleaning robot 400 discussed above; FIGS. 5A and 5B show additional details of the mobile cleaning robot 400. For example, FIGS. 5A and 5B show that the cleaning head assembly 405 can include a casing 478 configured to support the cleaning head assembly 405 where the casing 478 can be connected to the housing 401. The casing 478 can also include one or more links 480 connected to the cleaning head (e.g., including cleaning rollers 105*a* and 105*b*) and the housing 474 where the one or more links 480 can allow the rollers and the housing 474 to move with respect to the casing 478 and therefore the housing 401.

FIGS. 5A and 5B also show that the upper support 460 can define a raceway 461 therein or therethrough. The raceway 461 can be configured to support one or more conduits or wires 463 therein or therethrough. The upper support 460 can also include a connection portion 482 (shown in FIG. 5B) that can be configured to receive and retain the support 464 of the cleaning head suspension system 458 therein such as to secure the cleaning head suspension system 458 to the upper support 460 and therefore to the housing 401. FIG. 5B also shows how the connector 470 can extend downward from the connection portion 482, such that the connector 470 can engage the connection portion 472 to connect the rigid portion 456*a* of the plenum 456 to the cleaning head suspension system 458. FIGS. 5A and 5B also show that the connection portion 482 and the support 464 can optionally be configured such that the wires 463 extend under the support 464 or over the support 464. In these ways, the connection portion 482 of the upper support 460 can thereby provide a low-cost solution for securing the cleaning head suspension system 458 to the housing 401.

Figure 6B:
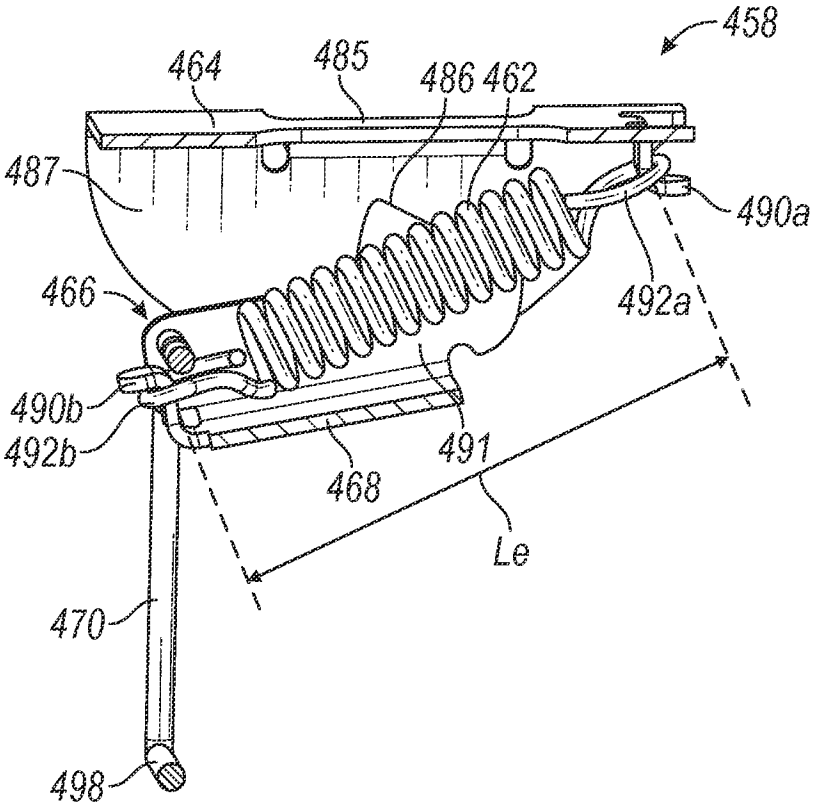
FIG. 6B illustrates a cross-sectional isometric view of a portion of a mobile cleaning robot cleaning head suspension system in a first condition.
Figure 6A:
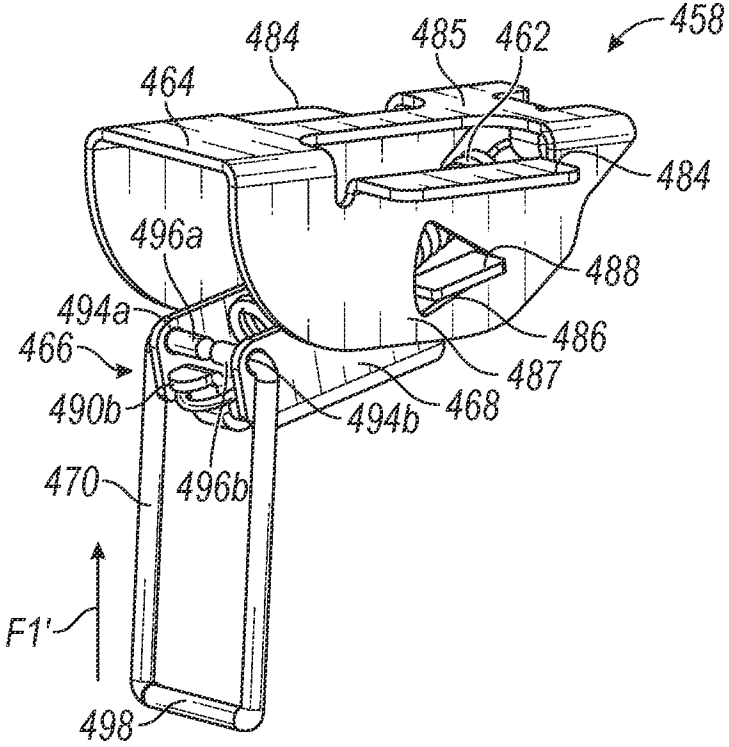
FIG. 6A illustrates an isometric view of a portion of a mobile cleaning robot cleaning head suspension system in a first condition.
Figure 7B:
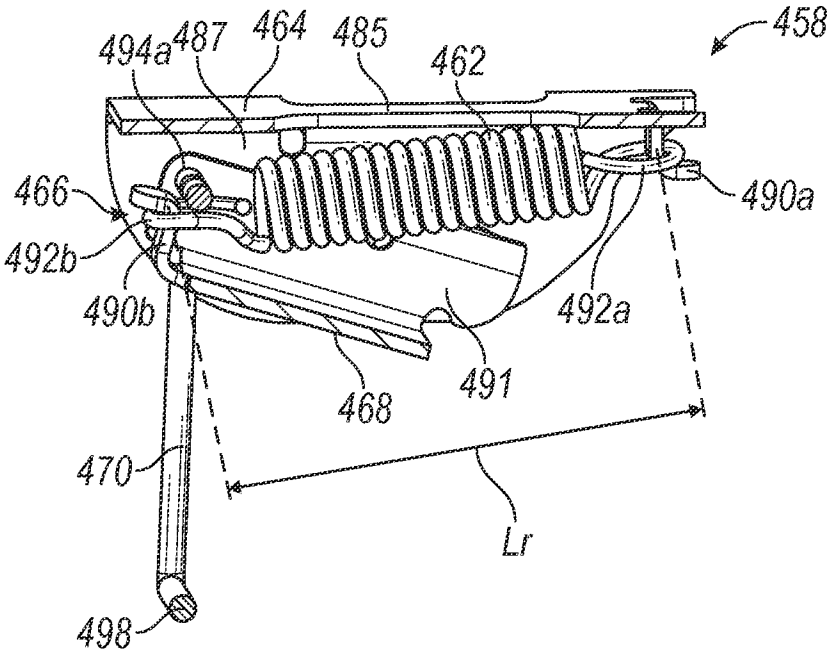
FIG. 7B illustrates a cross-sectional isometric view of a portion of a mobile cleaning robot cleaning head suspension system in a first condition.
Figure 7A:
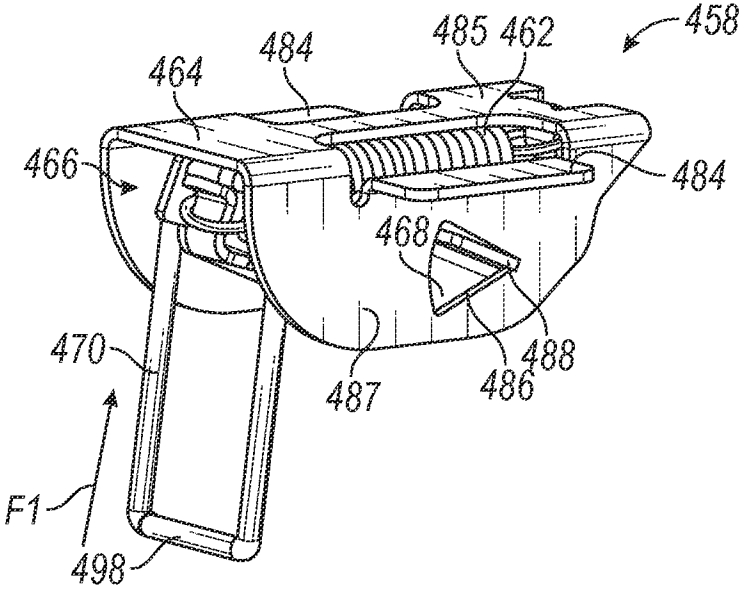
FIG. 7A illustrates an isometric view of a portion of a mobile cleaning robot cleaning head suspension system in a first condition.

FIG. 6A illustrates an isometric view of a portion of the cleaning head suspension system 458 in an extended position. FIG. 6B illustrates a cross-sectional isometric view of the cleaning head suspension system 458 in the extended position. FIG. 7A illustrates an isometric view of a portion of the cleaning head suspension system 458 in a retracted position. FIG. 7B illustrates a cross-sectional isometric view of the cleaning head suspension system 458 in the retracted position. FIGS. 6A-7B are discussed together below. The cleaning head suspension system 458 of FIGS. 6A-7B can be consistent with the cleaning head suspension system 458 discussed above; FIGS. 6A-7B discussed additional details of the cleaning head suspension system 458. The components of the cleaning head suspension system 458 can each be made of metal such as stainless steel, which can provide relatively low friction at a reasonable cost. However, other materials such as one or more of metals, polymers, ceramics, foams, or the like can be used.

For example, FIGS. 6A and 7A show that the support 464 can include wings 484. The wings 484 can extend laterally outward from a body 485 of the support 464. Optionally, the support 464 can be made of formed metal such that the wings 484 are cut and broken from the body 485 to extend outward. In other examples, the support 464 can be made of multiple pieces. The wings 484 can be configured to engage the upper support 460 (such as the connection portion 482) to limit downward movement of the support 464 with respect to the upper support 460 and therefore the housing 401.

FIGS. 6A and 7A also show that the body 485 of the support 464 can define windows 486. The windows 486 can extend through sidewalls or side portions 487 of the support 464. The windows 486 can be configured to receive and retain projections 488 of the armature 468 therein or therethrough such as to form a point of rotation or pivot between the armature 468 and the support 464. The windows 486 and the projections 488 can together define a knife-edge bearing which can provide a low friction and simple joint or bearing such as to allow relative rotation of the armature 468 with respect to the support 464. Other types of pivots, bearings, or joints can be used. For example, the armature 468 can includes cylindrical rods and the side portions 487 can include bores to form a journal bearing between the armature 468 and the support 464.

The support 464 can also include a tab 490*a* and the armature 468 can include a tab 490*b*. The tab 490*a* can be a projection extending from the body 485 and the tab 490*b* can be a projection extending from a body 491 of the armature 468. The tabs 490 can be configured to receive opposite end of the biasing element 462, such as mounting rings 492*a* and 492*b* thereof, to secure the biasing element 462 to the armature 468 and to the tab 490*a*. The mounting ring 492*a* can be captured or retained between the tab 490*a* and the body 485 of the support 464. Similarly, the mounting ring 492*b* can be captured or retained between the body 491 and the tab 490*b* of the armature 468. In this way, the biasing element 462 can be secured to the armature 468 and the support 464 and can be movable with the armature 468.

FIG. 6A also shows that the armature 468 can define bores 494*a* and 494*b* (bores 494) extending through side walls of the armature. The bores 494*a* and 494*b* can be configured to receive ends 496*a* and 496*b* of the connector 470, respectively, therein or therethrough to secure the connector 470 to the armature 468 and to form a bearing, joint, or pivot (such as a journal bearing) between the connector 470 and the armature 468. The ends 496 and the bores 494 can thereby enable relative rotation of the connector 470 with respect to the armature 468. The mounting ring 492*b* can be located or connected below the ends 496 of the 470 such as to allow the connector 470 to rotate within the bores without interference by the mounting rings 492*a*. This separation between the mounting rings 492*b* and the rotation point of the connector 470 (ends 496) helps to limit friction caused by rotation of the connector 470 within the bores 494. The connector 470 can extend downward or away from the bores 494 to form an end 498, which can be a relatively flat or straight section of the connector 470. The end 498 can be configured (e.g., sized or shaped) to be received and retained by the recess 476 of the cleaning head 406 to secure the connector 470 to the cleaning head 405.

In operation of some examples, when the cleaning head suspension system 458 is secured to the housing 401, such as via the upper support 460, as discussed above, the end 498 can be secured to the recess 476 to form a connection between the cleaning head suspension system 458 and the plenum 456. Then, as the cleaning head 405 moves between an extended position and a retracted position, the cleaning head suspension system 458 can move with the cleaning head assembly 405, such that the linkage 466 and the biasing element 462 apply a force to bias the cleaning head 405 toward the retracted position.

That is, when the cleaning head assembly 405 moves from a retracted position to an extended position, the cleaning head suspension system 458 can also move from the retracted position shown in FIGS. 7A-7B to the extended position shown in FIGS. 6A-6B, respectively. When the cleaning head assembly 405 and the cleaning head suspension system 458 are in the retracted position, the connector 470 can apply the force F1. As the cleaning head assembly 405 and the cleaning head suspension system 458 move toward the extended position, the force F1 can change in direction and magnitude, changing the force applied to the plenum 456. For example, as shown in FIG. 6A the force F1' can be applied by the connector 470 in the extended position which can have a different direction and magnitude than the force F1 of FIG. 7A. The force variation can be a result of the dynamics or movement of the components of the cleaning head suspension system 458. In some examples, the force F1 can reduce as the cleaning head 405 moves toward the retracted position. In other examples, the force F1 can increase or remain constant. In yet other examples, the force F1 can increase and decrease depending on the location of the linkage 466 and the cleaning head assembly 405.

More specifically, when the cleaning head suspension system 458 is in the retracted position, as shown in FIGS. 7A-7B, the armature 468 can be rotated (about the projections 488 and the windows 486) to a retracted position such that the biasing element 462 is in its shortest configuration, having a length of Lr. The force generated by the biasing element 462 at its length of Lr can be transferred to the tab 490*b* of the armature 468. In receipt of the force, the armature 468 is biased to rotate upward about the projections 488 and the windows 486, such that the armature 468 applies a force on the connector 470 via the ends 496 and the bores 494. The force is transferred by the end 498 of the connector 470 to the cleaning head 405 via the recess 476 to apply the force F1 to the cleaning head assembly 405 to bias the cleaning head assembly 405 upward.

Upward movement of the cleaning head assembly 405 can be limited by the linkages of the cleaning head assembly 405, but can optionally be limited by other components, such as engagement between the projections 488 and an upper portion of the windows 486. Optionally, the upper and lower portions of the windows 486 can be located or sized to be beyond the range of motion of the projections 488 (and the armature 468) such as to avoid limiting the range of rotation of the armature 468.

In this retracted position, the connector 470 and the end 498 can be rotated upward, and optionally at an angle with respect to a direction of a gravitational force, to create the force F1. Independent rotation of the connector 470 with respect to the armature 468 and the armature 468 with respect to the support 464 can allow for the end 498 to move along a desired path with the cleaning head assembly 405. Optionally, the rotational points and components lengths of the cleaning head suspension system 458 can be configured (e.g., sized or shaped) to achieve a desired movement path of the end 498 as the cleaning head suspension system 458 moves between the retracted position and the extended position.

As the cleaning head assembly 405 moves from the retracted position to the extended position, such as due to a change in floor surface type (height) and therefore a change in location of a ground reaction force, the cleaning head assembly 405 can move downward causing the cleaning head assembly 405 to pull the end 498 and therefore the connector 470 downward (or along a downward arc). Movement or rotation downward of the connector 470 can include rotation of the connector 470 about the bores 494. Also, movement of the connector 470 can be guided by downward rotation of the armature 468 with respect to the support 464 (as guided by the projections 488 and the windows 486). This downward movement of the armature 468 can result in movement of the tab 490*b* and therefore movement of the mounting rings 492*a* and therefore movement (such as stretching or elongating) of the biasing element 462.

In the extended position or condition of the armature 468, as shown in FIGS. 6A and 6B, the biasing element 462 can be stretched to its maximum length, Le, which is longer than the length Lr and therefore increases the spring force applied by the biasing element 462 to the armature 468, resulting in the force F1'. As discussed in further detail below, because the moment arm of the linkage 466 changes as the length of the biasing element 462 changes, the forces F1 and F1' can be similar or different, as desired. In other words, the linkage 466 and biasing element 462 can be configured to alter the force delivered by the biasing element 462 to the plenum 456, such as to deliver a desired force profile to the cleaning head 405 over a range of movement of the cleaning head 405 between the extended position and the retracted position. The cleaning head suspension system 458 also can be configured or designed to help to balance the downforce (e.g., F4) on the cleaning head 405 laterally, such as in the left-right directions.

Figure 8:
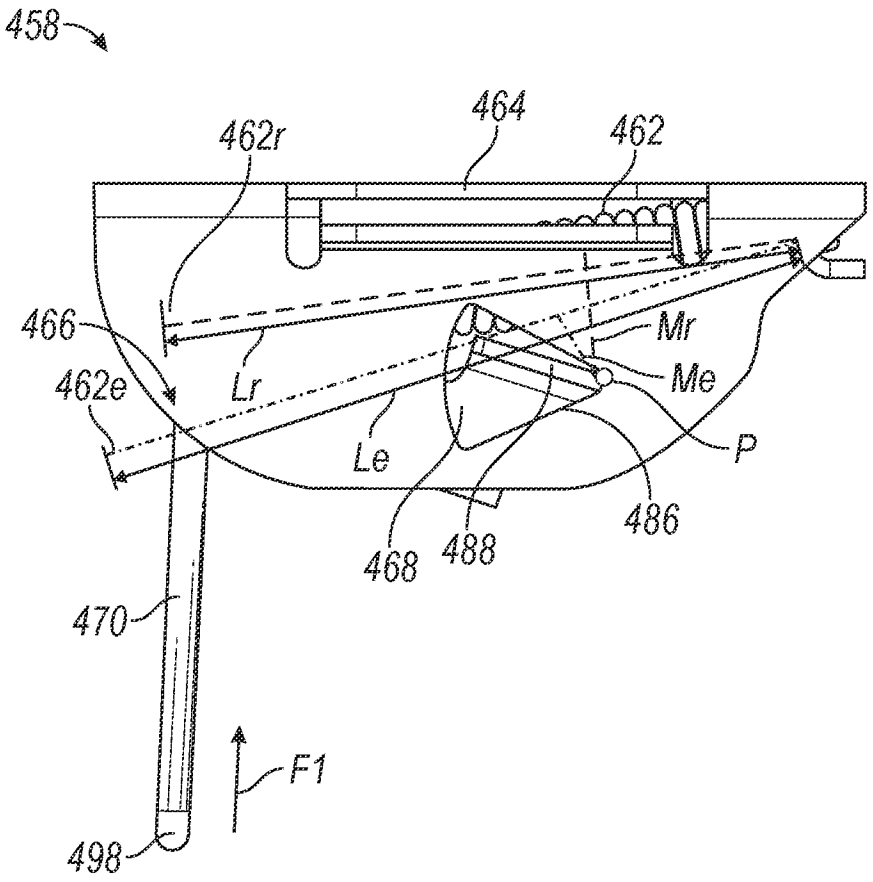
FIG. 8 illustrates a side view of a portion of a mobile cleaning robot cleaning head suspension system.

FIG. 8 illustrates a side view of a portion of the mobile cleaning robot cleaning head suspension system showing representations of some components of the cleaning head suspension system 458. For example, FIG. 8 shows biasing element 462*e* represents the biasing element in an extended position and biasing element 462*r* represents the biasing element in a retracted position. FIG. 8 also shows a moment arm between a pivot P of the armature 468 and the biasing element 462 in two positions. The moment arm Me is the moment arm in the extended position and the moment arm Mr is the moment arm in the retracted position.

FIG. 8 illustrates that, when the armature 468 is in the retracted position, the moment arm Mr can be larger than the moment arm Me when the armature 468 is in the extended position. As discussed above with respect to FIGS. 6B and 7B, when the armature 468 is in the extended position, the biasing element 462 can have the length Le. And, when the armature 468 is in the retracted position, the biasing element 462 can have the length Lr, which is shorter than the length Le. The force of the biasing element 462 increases as the length increases meaning the force of the biasing element 462 is higher when the cleaning head suspension system 458 is in the extended position.

Because the moment arm Me is shorter than the moment arm Mr, the larger force of the biasing element 462 in the extended position can be reduced such that the force F1 of the retracted position can be higher than the force F1' of the extended position to help compensate for the force of the flexible portion 456*b* of the plenum 456. The linkage 466 or the cleaning head suspension system 458 can thereby provide a force F1 throughout the range of motion of the cleaning head suspension system 458 between the extended position and the retracted position required to provide a constant downforce F4. In this way, the cleaning head suspension system 458 can deliver a relatively constant force at a desired force value to the cleaning head assembly 405 over a range of movement of the cleaning head assembly 405. Alternatively, the components of the cleaning head suspension system 458 can be configured to provide a constant force or a different force profile.

Though the cleaning head suspension system 458 is discussed as providing a relatively consistent force over its range of movement, the cleaning head suspension system 458 can be tuned to deliver a desired force profile (such as increasing force, decreasing force, constant force, or varied force) by altering one or more of the biasing element 46, the armature 468, the connector 470, or the support 464.

In some examples, the cleaning head suspension system 458 can be designed such that the projections 488 engage the windows 486 around a neutral axis of the biasing element 462 and the armature 468. In this way, the armature 468 can lock or stop when it reaches the neutral axis which can optionally be at a contact point between the projections 488 and the windows 486.

In some examples, the projections 488 can be sized to allow the armature 468 to move past its neutral axis. When this occurs, the force F1 can reverse, applying a downforce on the cleaning head assembly 405. In this way, the cleaning head suspension system 458 can be designed to provide a force with varying directions over the range of movement of the cleaning head assembly 405 with respect to the housing 401. Optionally, the cleaning head suspension system 458 can be designed or configured such that the biasing element 462 delivers a downforce instead of a lifting force.

Figure 9:
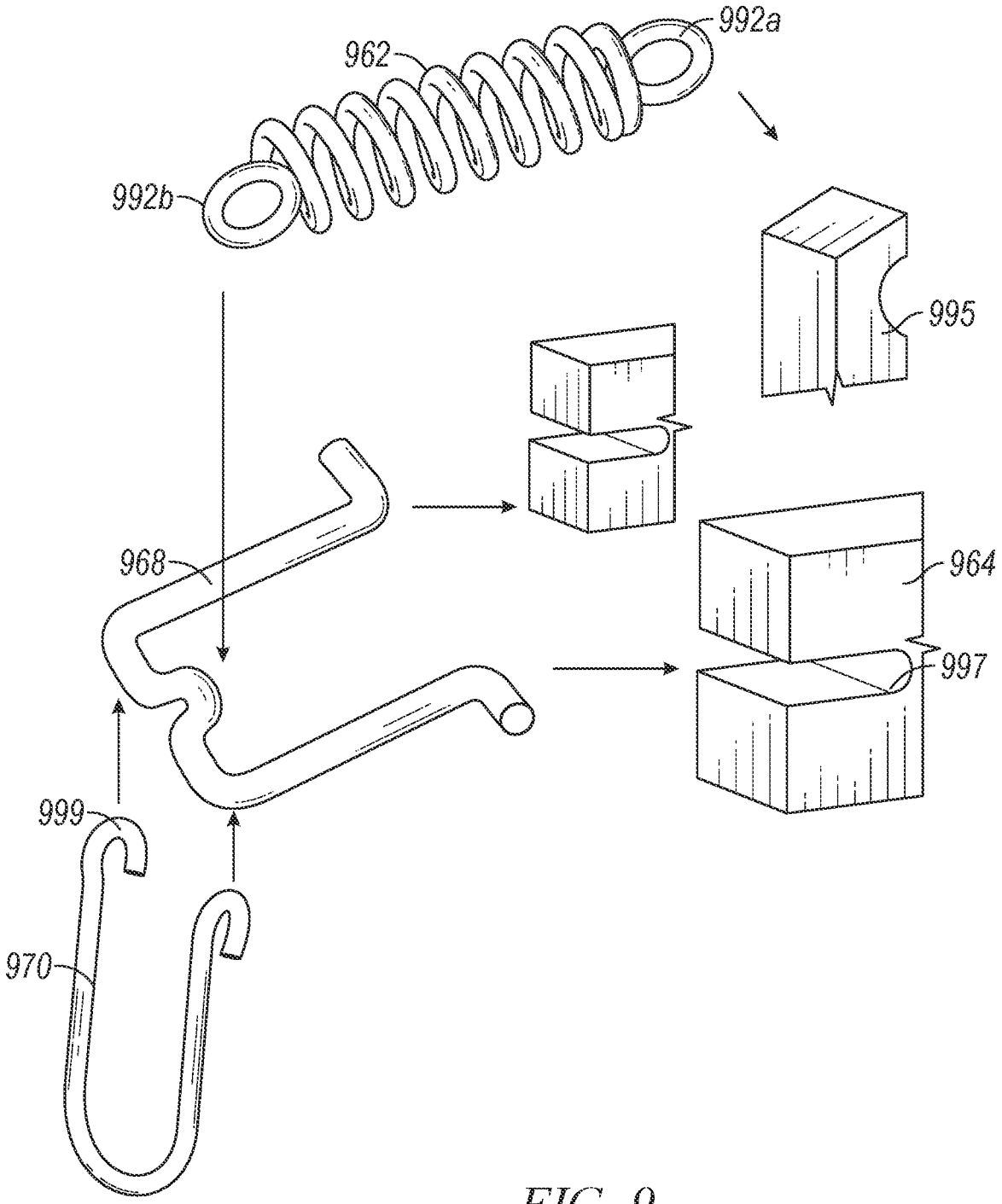
FIG. 9 illustrates an exploded view of a portion of a mobile cleaning robot cleaning head suspension system.

FIG. 9 illustrates an exploded view of a cleaning head suspension system 958 of a mobile cleaning robot cleaning head suspension system. The cleaning head suspension system 958 can be similar to the cleaning head suspension system 458 discussed above, but the components of the cleaning head suspension system 958 can vary.

For example, a connector 970 of the cleaning head suspension system 958 can include hooks 999 that are securable to a frame of an armature 968, where the frame can be a wire or rod frame. In this way, both the armature 968 and the connector 970 can be made from wire or low-gauge rod material, which can be relatively low cost. FIG. 9 also shows that a biasing element 962 can be similar to the biasing element 462 in that it can include rings 992*a* and 992*b*. The ring 992*b* can be connected to the armature 968 and the ring 992*a* can be connected to a hook 995 of a support 964. The support 964 can also include slots 997 to receive and retain arms of the 968 such as to form a bearing, pivot or joint for the 968.

The cleaning head suspension system 958 can operate similar to the system 458 discussed above, in that the cleaning head suspension system 958 can be configured to deliver a force from the biasing element 962 to a cleaning head assembly to bias the assembly (e.g., 105) to a retracted position. The cleaning head suspension system 958 can also be configured such that the delivered force is constant or such that the delivered force has a desired profile over a range of movement of the cleaning head assembly and a range of movement of the armature 968.

NOTES AND EXAMPLES

The following, non-limiting examples, detail certain aspects of the present subject matter to solve the challenges and provide the benefits discussed herein, among others.

Example 1 is a mobile cleaning robot movable within an environment, the mobile cleaning robot comprising: a body; a cleaning head operable to extract debris from a floor surface and to move vertically relative to the body between an extended position and a retracted position; a biasing element connected to the body and movable with the cleaning head; and a linkage connected to the cleaning head and the biasing element, the linkage rotatably connected to the body to, together with the biasing element, bias the cleaning head toward the retracted position.

In Example 2, the subject matter of Example 1 optionally includes a support connected to the body and connected to the linkage, a first end of the biasing element connected to the support.

In Example 3, the subject matter of Example 2 optionally includes wherein the linkage includes: an armature rotatably connected to the support and connected to the biasing element; and a connector member connected to the cleaning head and connected to the armature.

In Example 4, the subject matter of Example 3 optionally includes wherein the armature includes projections extending through respective windows of the support to enable relative rotation of the armature with respect to the support.

In Example 5, the subject matter of Example 4 optionally includes wherein the armature includes a bore configured to receive an end of the connector member therein to form a pivoting connection between the connector member and the armature.

In Example 6, the subject matter of Example 5 optionally includes wherein the armature includes a body and a tab connected to the body, a second end of the biasing element captured by the tab and the body.

In Example 7, the subject matter of any one or more of Examples 2-6 optionally include wherein the linkage is connected to a plenum of the cleaning head and the plenum is connected to the body.

In Example 8, the subject matter of Example 7 optionally includes wherein the support is connected to a wire raceway connected to the body.

In Example 9, the subject matter of any one or more of Examples 1-8 optionally include wherein the linkage and the biasing element are configured to apply a force to bias the cleaning head toward the retracted position, wherein the force reduces as the cleaning head moves toward the retracted position.

In Example 10, the subject matter of any one or more of Examples 1-9 optionally include wherein the linkage and the biasing element are configured to deliver a desired force profile to the cleaning head over a range of movement of the cleaning head between the extended position and the retracted position.

Example 11 is a mobile cleaning robot movable within an environment, the mobile cleaning robot comprising: a body; a cleaning head operable to extract debris from a floor surface and to move vertically relative to the body between an extended position and a retracted position; a biasing element connected to the body and movable with the cleaning head; and a linkage connected to the cleaning head and the biasing element, the linkage rotatably connected to the body to, together with the biasing element, to apply a force to bias the cleaning head toward the retracted position that reduces as the cleaning head moves toward the retracted position.

In Example 12, the subject matter of Example 11 optionally includes a support connected to the body and connected to the linkage, a first end of the biasing element connected to the support.

In Example 13, the subject matter of Example 12 optionally includes wherein the linkage is connected to a plenum of the cleaning head and the plenum is connected to the body.

In Example 14, the subject matter of Example 13 optionally includes wherein the support is connected to a wire raceway connected to the body.

Example 15 is a mobile cleaning robot movable within an environment, the mobile cleaning robot comprising: a body; a cleaning head operable to extract debris from a floor surface and to move vertically relative to the body between an extended position and a retracted position; a biasing element connected to the body and movable with the cleaning head; and a linkage connected to the cleaning head and the biasing element, the linkage rotatably connected to the body to, together with the biasing element, to apply a force to deliver a desired force profile to the cleaning head over a range of movement of the cleaning head between the extended position and the retracted position.

In Example 16, the subject matter of Example 15 optionally includes a support connected to the body and connected to the linkage, a first end of the biasing element connected to the support.

In Example 17, the subject matter of Example 16 optionally includes wherein the linkage includes: an armature rotatably connected to the support and connected to the biasing element; and a connector member connected to the cleaning head and connected to the armature.

In Example 18, the subject matter of Example 17 optionally includes wherein the armature includes projections extending through respective windows of the support to enable relative rotation of the armature with respect to the support.

In Example 19, the subject matter of Example 18 optionally includes wherein the armature includes a bore configured to receive an end of the connector member therein to form a pivoting connection between the connector member and the armature.

In Example 20, the subject matter of Example 19 optionally includes wherein the armature includes a body and a tab connected to the body, a second end of the biasing element captured by the tab and the body.

In Example 21, the apparatuses or method of any one or any combination of Examples 1-20 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A mobile cleaning robot movable within an environment, the mobile cleaning robot comprising:

a body;

a cleaning head operable to extract debris from a floor surface and to move vertically relative to the body between an extended position and a retracted position;

a biasing element connected to the body and movable with the cleaning head;

a linkage connected to the cleaning head and the biasing element, the linkage rotatably connected to the body to, together with the biasing element, bias the cleaning head toward the retracted position; and a support connected to the body and connected to the linkage, a first end of the biasing element connected directly to the support and a second end of the biasing element connected directly to the linkage.

2. The mobile cleaning robot of claim 1, wherein the linkage includes:

an armature rotatably connected to the support and connected to the biasing element; and a connector member connected to the cleaning head and connected to the armature.

3. The mobile cleaning robot of claim 2, wherein the armature includes projections extending through respective windows of the support to enable relative rotation of the armature with respect to the support.

4. The mobile cleaning robot of claim 3, wherein the armature includes a bore configured to receive an end of the connector member therein to form a pivoting connection between the connector member and the armature.

5. The mobile cleaning robot of claim 4, wherein the armature includes a body and a tab connected to the body, a second end of the biasing element captured by the tab and the body.

6. The mobile cleaning robot of claim 1, wherein the linkage is connected to a plenum of the cleaning head and the plenum is connected to the body.

7. The mobile cleaning robot of claim 6, wherein the support is connected to a wire raceway connected to the body.

8. The mobile cleaning robot of claim 1, wherein the linkage and the biasing element are configured to apply a force to bias the cleaning head toward the retracted position, wherein the force reduces as the cleaning head moves toward the retracted position.

9. A mobile cleaning robot movable within an environment, the mobile cleaning robot comprising:

a body;

a cleaning head operable to extract debris from a floor surface and to move vertically relative to the body between an extended position and a retracted position;

a biasing element connected to the body and movable with the cleaning head;

a linkage connected to the cleaning head and the biasing element, the linkage rotatably connected to the body to, together with the biasing element, to apply a force to bias the cleaning head toward the retracted position that reduces as the cleaning head moves toward the retracted position; and a support connected to the body and connected to the linkage, a first end of the biasing element connected directly to the support and a second end of the biasing element connected directly to the linkage.

10. The mobile cleaning robot of claim 9, wherein the linkage is connected to a plenum of the cleaning head and the plenum is connected to the body.

11. The mobile cleaning robot of claim 10, wherein the support is connected to a wire raceway connected to the body.

12. A mobile cleaning robot movable within an environment, the mobile cleaning robot comprising:

a body;

a cleaning head operable to extract debris from a floor surface and to move vertically relative to the body between an extended position and a retracted position;

a plenum connected to the body and connected to the cleaning head;

a biasing element connected to the body and movable with the cleaning head;

a linkage connected directly to a first end of the biasing element, the linkage rotatably connected to the body to, together with the biasing element, apply a force to the plenum to deliver a varied force to the cleaning head over a range of movement of the cleaning head between the extended position and the retracted position; and a support connected to the body and connected to the linkage, a second end of the biasing element connected directly to the support.

13. The mobile cleaning robot of claim 12, wherein the linkage includes:

an armature rotatably connected to the support and connected to the first end of the biasing element; and a connector member connected to the cleaning head and connected to the armature.

14. The mobile cleaning robot of claim 13, wherein the armature includes projections extending through respective windows of the support to enable relative rotation of the armature with respect to the support.

15. The mobile cleaning robot of claim 14, wherein the armature includes a bore configured to receive an end of the connector member therein to form a pivoting connection between the connector member and the armature.

16. The mobile cleaning robot of claim 15, wherein the armature includes a body and a tab connected to the body, the a second first end of the biasing element captured by the tab and the body.

* * * * *